US007849539B2

(12) United States Patent
Hornbach et al.

(10) Patent No.: US 7,849,539 B2
(45) Date of Patent: Dec. 14, 2010

(54) FRAME FOR A PATIENT-SUPPORT APPARATUS

(75) Inventors: David W. Hornbach, Brookville, IN (US); Darrell L. Metz, Batesville, IN (US); Terry J. Stratman, Villa Hills, KY (US)

(73) Assignee: Hill-Rom Services, Inc., Wilmington, DE (US)

( * ) Notice: Subject to any disclaimer, the term of this patent is extended or adjusted under 35 U.S.C. 154(b) by 399 days.

(21) Appl. No.: 11/960,303

(22) Filed: Dec. 19, 2007

(65) Prior Publication Data

US 2008/0148484 A1 Jun. 26, 2008

Related U.S. Application Data

(60) Provisional application No. 60/871,017, filed on Dec. 20, 2006, provisional application No. 60/884,793, filed on Jan. 12, 2007, provisional application No. 60/956,805, filed on Aug. 20, 2007.

(51) Int. Cl.
*A61G 7/015* (2006.01)
*A61G 7/005* (2006.01)
*A61G 7/018* (2006.01)

(52) U.S. Cl. ..... 5/618; 5/613; 5/610

(58) Field of Classification Search ..... 5/618, 5/616, 617, 613, 600, 610, 425, 424, 428
See application file for complete search history.

(56) References Cited

U.S. PATENT DOCUMENTS

| | | | | |
|---|---|---|---|---|
| 3,565,501 | A | 2/1971 | Bowen et al. | |
| 3,593,350 | A | 7/1971 | Knight et al. | |
| 3,821,821 | A | 7/1974 | Burst et al. | |
| 3,898,702 | A | 8/1975 | Goodman | |
| 4,271,830 | A | 6/1981 | Moon | |
| 4,361,917 | A | 12/1982 | Wilson | |
| 4,381,571 | A | 5/1983 | Elliott | |
| 4,385,410 | A | 5/1983 | Elliott et al. | |
| 4,407,030 | A | 10/1983 | Elliott | |
| 4,435,862 | A | 3/1984 | King et al. | |
| 4,862,529 | A * | 9/1989 | Peck | 5/611 |
| 5,185,894 | A | 2/1993 | Bastert et al. | |
| 5,257,428 | A | 11/1993 | Carroll et al. | |
| 5,494,333 | A | 2/1996 | Wilson | |

(Continued)

FOREIGN PATENT DOCUMENTS

EP 0 316 905 A2 5/1989

(Continued)

OTHER PUBLICATIONS

International Search Report for Application PCT/US2007/088068, May 16, 2008, 3 pages.

(Continued)

*Primary Examiner*—Robert G Santos
(74) *Attorney, Agent, or Firm*—Barnes & Thornburg LLP

(57) ABSTRACT

A patient-support apparatus includes a patient-support deck having a head deck section, seat deck section, and foot deck section each of which is supported on a frame. The head deck section pivots and translates relative to the frame when driven. The drive systems of the deck sections are configured such that movement of links driving the deck sections occurs above the lowest point on the frame.

24 Claims, 9 Drawing Sheets

U.S. PATENT DOCUMENTS 5,502,849 A 4/1996 Mitchell
5,537,701 A 7/1996 Elliott
5,577,279 A 11/1996 Foster et al.
5,577,280 A 11/1996 Elliott
5,579,550 A 12/1996 Bathrick et al.
5,600,214 A 2/1997 Fromson
5,608,932 A 3/1997 Hasegawa
5,640,730 A 6/1997 Godette
5,680,661 A 10/1997 Foster et al.
5,682,629 A 11/1997 Bortoluzzi
5,682,631 A * 11/1997 Weismiller et al. ..... 5/618
5,708,997 A * 1/1998 Foster et al. ..... 5/618
5,715,548 A * 2/1998 Weismiller et al. ..... 5/624
5,740,568 A 4/1998 Elliott
5,790,997 A * 8/1998 Ruehl ..... 5/618
5,870,784 A 2/1999 Elliott
5,933,888 A * 8/1999 Foster et al. ..... 5/604
6,006,379 A 12/1999 Hensley
6,088,853 A 7/2000 Jansen
6,101,647 A 8/2000 Stroud et al.
6,112,345 A * 9/2000 Foster et al. ..... 5/81.1 R
6,163,903 A * 12/2000 Weismiller et al. ..... 5/610
6,336,235 B1 * 1/2002 Ruehl ..... 5/610
6,363,552 B1 * 4/2002 Hornbach et al. ..... 5/425
6,374,436 B1 * 4/2002 Foster et al. ..... 5/81.1 R
6,539,566 B1 * 4/2003 Hayes ..... 5/618
6,640,360 B2 * 11/2003 Hornbach et al. ..... 5/425
6,640,365 B1 11/2003 Chang
6,694,548 B2 * 2/2004 Foster et al. ..... 5/600
6,702,305 B2 3/2004 Miles
6,711,761 B2 3/2004 Choi
6,725,474 B2 * 4/2004 Foster et al. ..... 5/81.1 R
6,742,205 B2 6/2004 Dewert
6,754,922 B2 6/2004 Dewert
6,763,536 B2 7/2004 Dewert
6,826,793 B2 12/2004 Tekulve
6,889,396 B2 5/2005 Weinman
6,907,631 B2 6/2005 Heaton
6,908,154 B2 6/2005 Aono
6,951,037 B2 10/2005 Weinman et al.
6,961,971 B2 11/2005 Schneider et al.
6,990,698 B2 1/2006 Wall, Sr.
7,000,269 B2 2/2006 Borda
7,036,165 B2 5/2006 Weinman et al.
7,073,219 B2 7/2006 Poulin et al.
7,080,439 B2 7/2006 Weinman et al.
7,088,507 B2 8/2006 Peterson
7,093,312 B2 8/2006 Mossbeck
7,134,156 B2 11/2006 Mossbeck
7,174,588 B1 2/2007 Chen
7,198,325 B2 4/2007 Dewert
7,213,279 B2 * 5/2007 Weismiller et al. ..... 5/624
7,237,286 B1 7/2007 Kim
7,257,850 B1 8/2007 Tekulve
7,296,312 B2 11/2007 Menkedick et al.
7,325,265 B2 2/2008 Hornbach et al.
7,386,901 B2 6/2008 Dewert et al.
7,406,731 B2 8/2008 Menkedick et al.
7,441,291 B2 10/2008 Hayes et al.
7,461,420 B2 12/2008 Kim
7,472,442 B2 1/2009 Mossbeck
7,480,951 B2 * 1/2009 Weismiller et al. ..... 5/600
7,484,257 B2 2/2009 Schneider et al.
2002/0059679 A1 * 5/2002 Weismiller et al. ..... 5/610
2002/0095724 A1 * 7/2002 Hornbach et al. ..... 5/425
2006/0000021 A1 * 1/2006 Hayes et al. ..... 5/618
2006/0150332 A1 * 7/2006 Weismiller et al. ..... 5/600
2006/0168729 A1 * 8/2006 Weismiller et al. ..... 5/618
2006/0260054 A1 11/2006 Lubbers et al.
2007/0180618 A1 * 8/2007 Weismiller et al. ..... 5/600
2008/0148484 A1 * 6/2008 Hornbach et al. ..... 5/601

FOREIGN PATENT DOCUMENTS

GB 1230059 4/1971

OTHER PUBLICATIONS

Written Opinion of the International Searching Authority for Application PCT/US2007/088068, May 16, 2008, 4 pages.

* cited by examiner

FRAME FOR A PATIENT-SUPPORT APPARATUS

This application claims priority under 35 U.S.C. §119(e) to U.S. Provisional Patent Application Nos. 60/871,017, filed Dec. 20, 2006, 60/884,793, filed Jan. 12, 2007, and 60/956,805, filed Aug. 20, 2007, each of which is hereby incorporated by reference herein.

BACKGROUND OF THE INVENTION

The present disclosure is related to patient-support apparatuses having deck sections which move relative to a support frame. More specifically, the present disclosure is related to a modularly constructed patient-support apparatus with compound movement of deck sections relative to a support frame.

Patient-support apparatuses, such as hospital beds, for example, are known to include deck sections which move relative to a support frame to reposition a person reclining on the bed. Movement of a head deck section is known to correspond with movement of a person from a lying position to a position with their back raised about their hips. In some cases, a seat section will also move relative to the support frame to rotate the person's thighs about their hips. This is known to help prevent the person from sliding toward a foot end of the bed. When the seat section and head section are each articulated, a person may experience discomfort due to compression of the abdomen when the two sections are raised.

SUMMARY OF THE INVENTION

The present disclosure comprises one or more of the features recited in the appended claims and/or the following features which, alone or in any combination, may comprise patentable subject matter:

According to the present disclosure, a patient-support apparatus embodied as a bed includes a support frame and a plurality of deck sections supported on the frame and moveable relative thereto. The patient-support apparatus includes a first deck section and a second deck section pivotable relative to the support frame about a first pivot axis. The patient-support apparatus further includes means for translating the first pivot axis along a longitudinal axis of the support frame such that the pivot axis moves away from the first deck section as the second deck section pivots upwardly relative to the support frame. In an illustrative embodiment, the means for translating the first pivot axis comprises a first carriage movable along a longitudinal axis of the support frame, a first actuator coupled to the support frame and the first carriage such that the first actuator is operable to move the carriage along the longitudinal axis of the support frame. The second deck section may be pivotably coupled to the carriage at a first pivot support which defines the first pivot axis. When the second deck section is pivotably coupled to the carriage, the second deck section may be coupled to the support frame by a link pivotably coupled to the second deck section and pivotably coupled to the support frame. The link may urge the second deck section to pivot as the carriage moves.

Also according to the present, a drive system for a deck section of a patient-support apparatus may comprise an actuator configured to be coupled to a first portion of the patient-support apparatus and a carriage coupled to the actuator. The carriage may include a plurality of roller brackets, a crossbar coupled to the roller brackets, and a plurality of rollers rotatably coupled to each of the roller brackets. Each roller may be rotatable about a respective axis. The axes of rotation of the rollers may cooperate to define a first plane. The actuator may extend and retract along an extension axis that is generally parallel to the first plane. The carriage may include a pivot support defining a pivot axis. The pivot support may be configured to support a deck section of the patient-support apparatus. When the carriage includes a pivot support, the pivot axis may translate in a second plane generally parallel to the first plane. The rollers of the carriage may be configured to be supported on the first portion of the patient-support apparatus.

In yet another aspect of the present disclosure, a patient-support apparatus may comprise a support frame, a first carriage, a first actuator coupled to support frame in the first carriage, and a first deck section movable relative to the support frame. The first actuator may be operable to move the first carriage along a longitudinal axis of the support frame. The first deck section may be pivotably coupled the carriage at a first pivot support and coupled to the support frame such that movement of the carriage translates the first pivot support along support frame and the first deck section is urged to pivot. The first deck section may pivot about the translating first pivot support as the first pivot support translates. The patient-support apparatus may be configured such that the first actuator does not pivot relative to the support frame as it extends and retracts.

The support frame may comprise to generally parallel longitudinal channels and a plurality of cross-members coupled to each of the longitudinal channels. The carriage may be configured to move along the longitudinal channels. The first actuator may be coupled to one of the cross-members to move the carriage relative to the support frame. In an illustrative embodiment, the carriage may comprise a pair of roller brackets, a crossbar coupled to the roller brackets, and a plurality of a rollers rotatably coupled to each of the roller brackets. The rollers may be configured to be received in longitudinal channels. The first actuator may be coupled to the crossbar such that extension of the first actuator moves the carriage away from the first cross-member.

The rollers of the carriage may each rotate about a respective rotation axis. The rotation axes may cooperate to find a first plane. The carriage may move in the first plane along the direction generally parallel to longitudinal axis of the support frame.

The first deck section may be coupled to the support frame by a link. The link may be pivotably coupled the first deck section and pivotably coupled to the support frame. The link may act on the first deck section as the carriage moves along longitudinal axis of the support frame to thereby cause the first deck section to pivot relative to the carriage.

The patient-support apparatus may further comprise a second carriage movable along the longitudinal axis of the support frame. The second carriage may be driven by a second actuator coupled to the support frame and the second carriage. The patient-support apparatus may further comprise a second deck section pivotably coupled to the support frame and coupled to the second carriage support such that movement of the second carriage urges the second deck section to pivot relative to the support frame.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
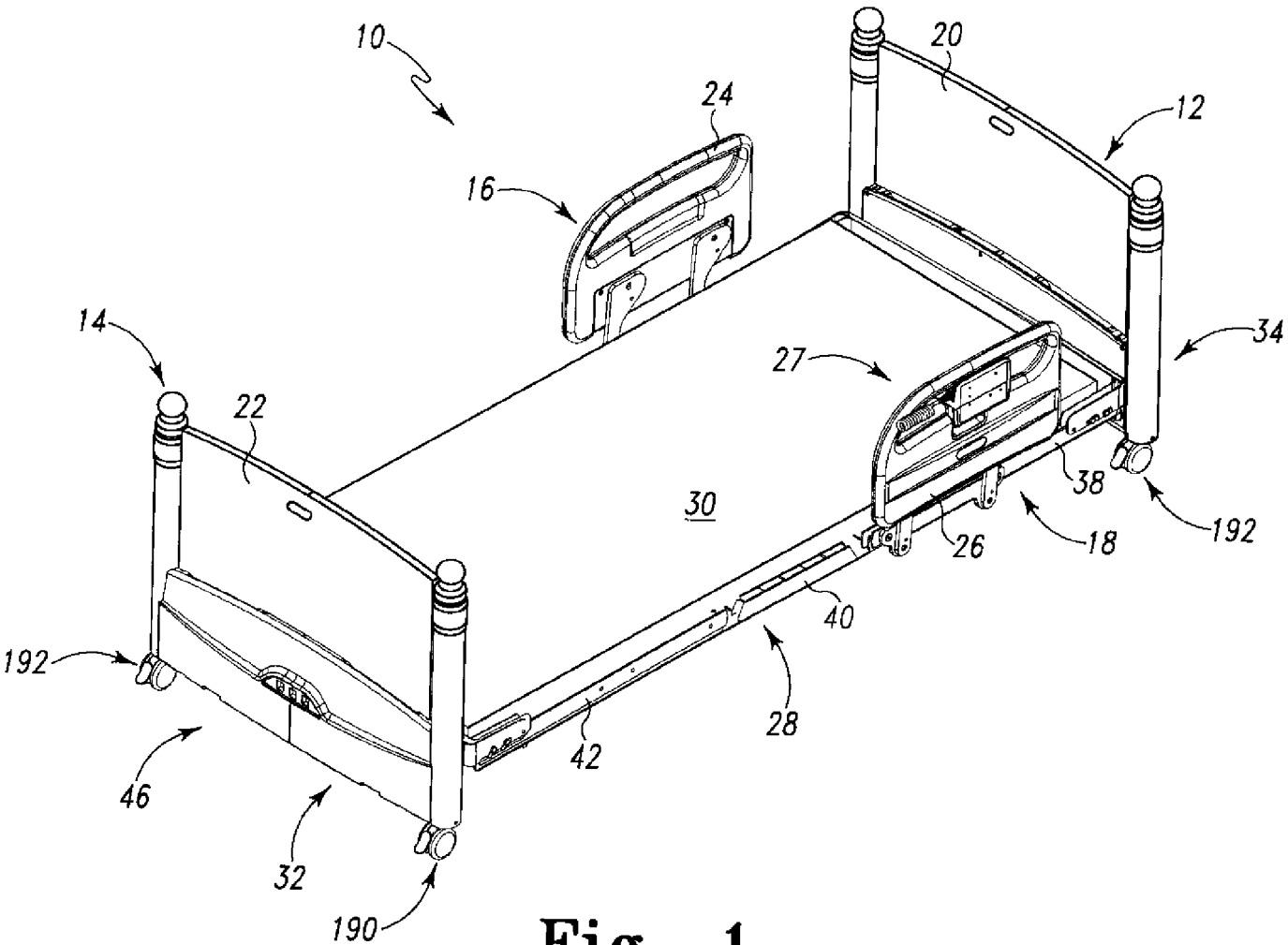
FIG. 1 is a perspective view of an embodiment of a patient-support apparatus including aspects of the present disclosure.

According to the present disclosure, a patient-support apparatus 10 embodied as a bed includes a patient-support platform 28 supported on two lift systems 32, 34 and movable vertically to change the elevation of the patient-support platform 28. Illustratively, bed 10 may be used either in a home or in an institution such as a hospital or nursing facility, for example. Bed 10 includes a panel 20 positioned near a head end 12 of the bed and a similar panel 22 positioned near the foot end 14 of the bed. In addition, a side rail 24 is positioned at the patient right 16 of the bed 10 and a second side rail 26 is positioned at the patient left 18 side of the bed 10. Illustratively, a pendant 27 is coupled to siderail 26. Pendant 27 is a user input device for an occupant of bed 10 or a caregiver to activate the various drives and functions of bed 10. It should be understood that the reference to "head and" and "foot end" of the bed 10 are provided for clarity in understanding the various figures and do not refer to any particular point or structure unless otherwise noted. Generally, a person occupies a bed such as bed 10 in a supine position and reference to patient right 16 and patient left 18 provide a basis for understanding the various figures.

Figure 5:
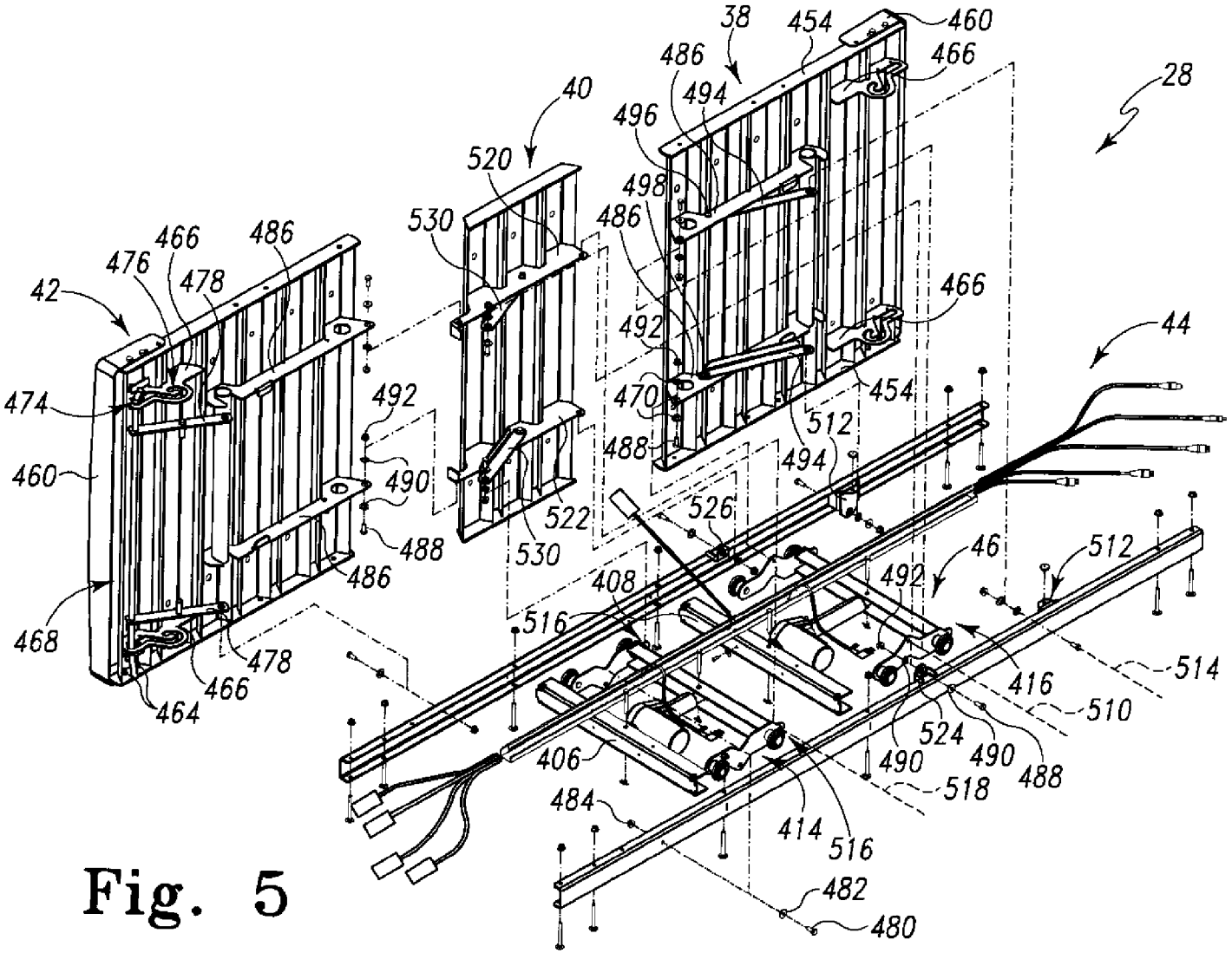
FIG. 5 is an exploded assembly view of the patient-support platform of FIG. 3.
Figure 6:
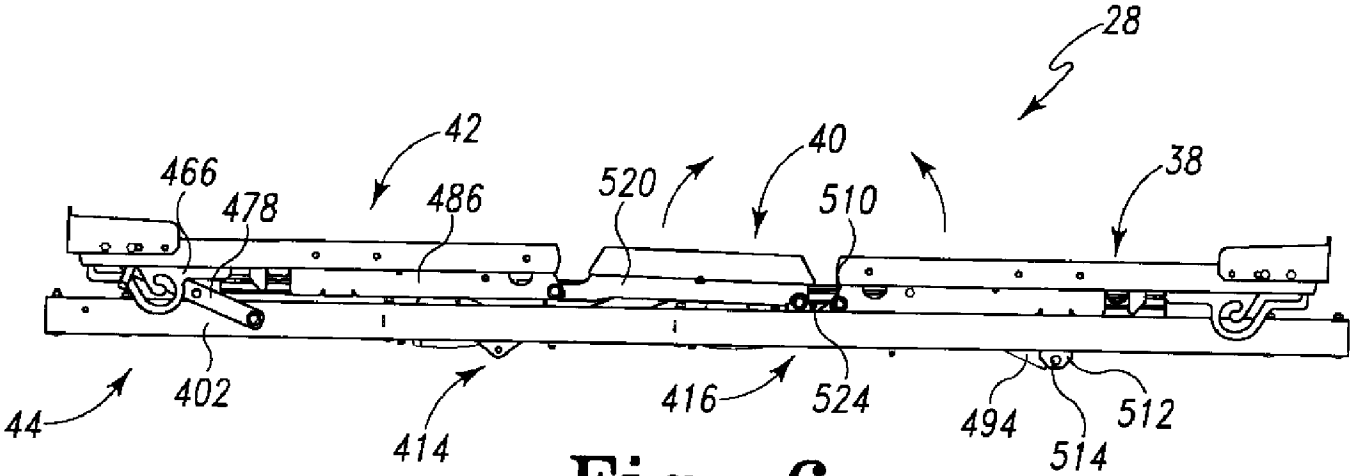
FIG. 6 is a side elevation view of the patient-support platform of FIG. 3 with deck sections of the patient-support platform positioned in a lowered position.
Figure 7:
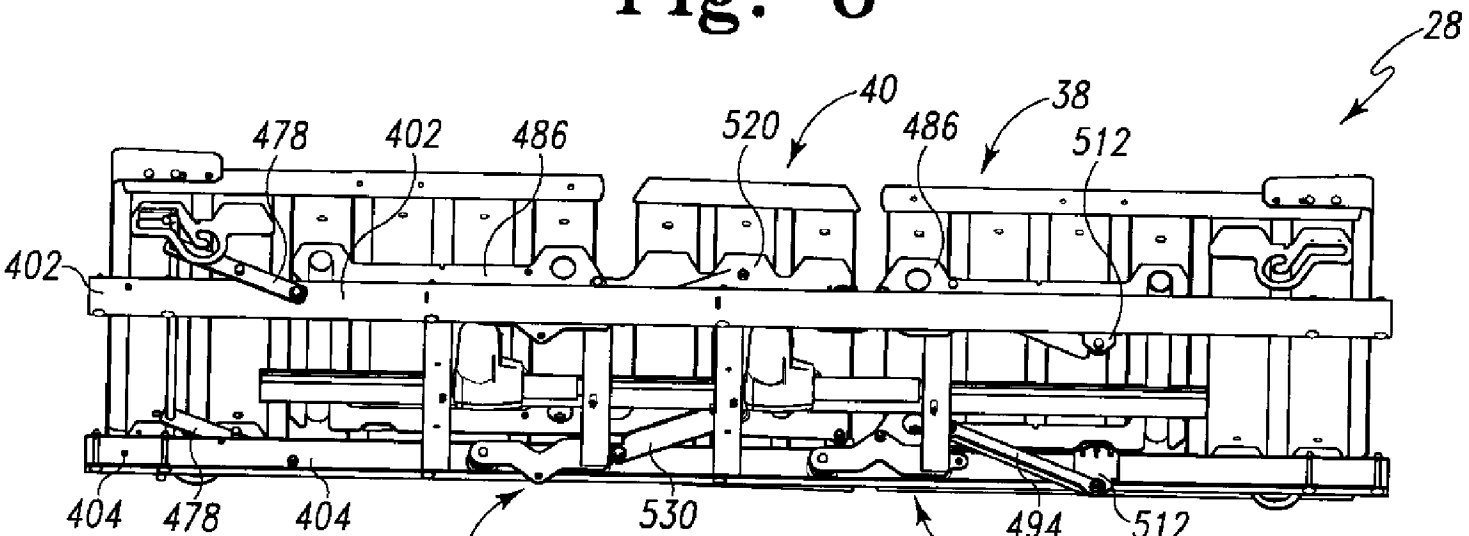
FIG. 7 is a perspective view of the patient-support platform of FIG. 6, the perspective taken from the below the platform on the patient left side of the platform.
Figure 8:
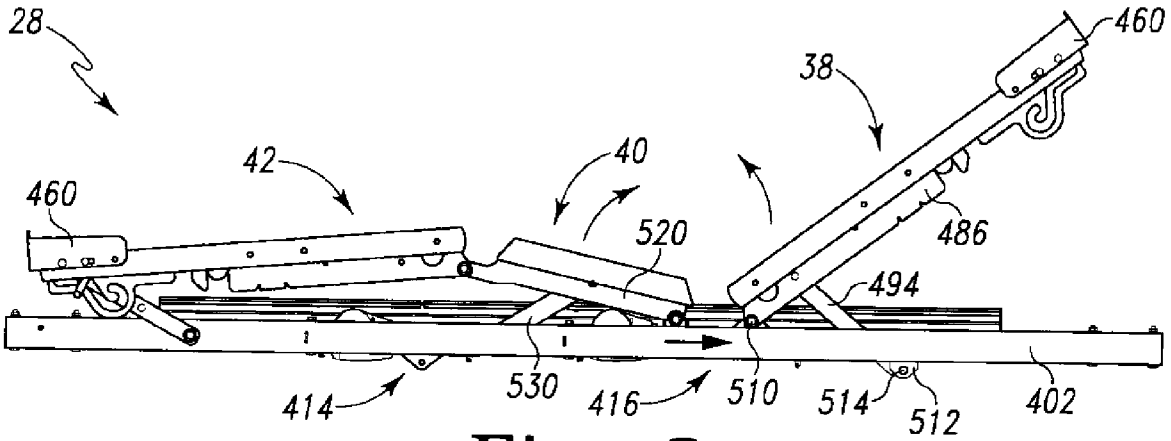
FIG. 8 is a side elevation view of the patient-support platform of FIG. 3 with various deck sections of the patient-support platform positioned in a raised position.
Figure 9:
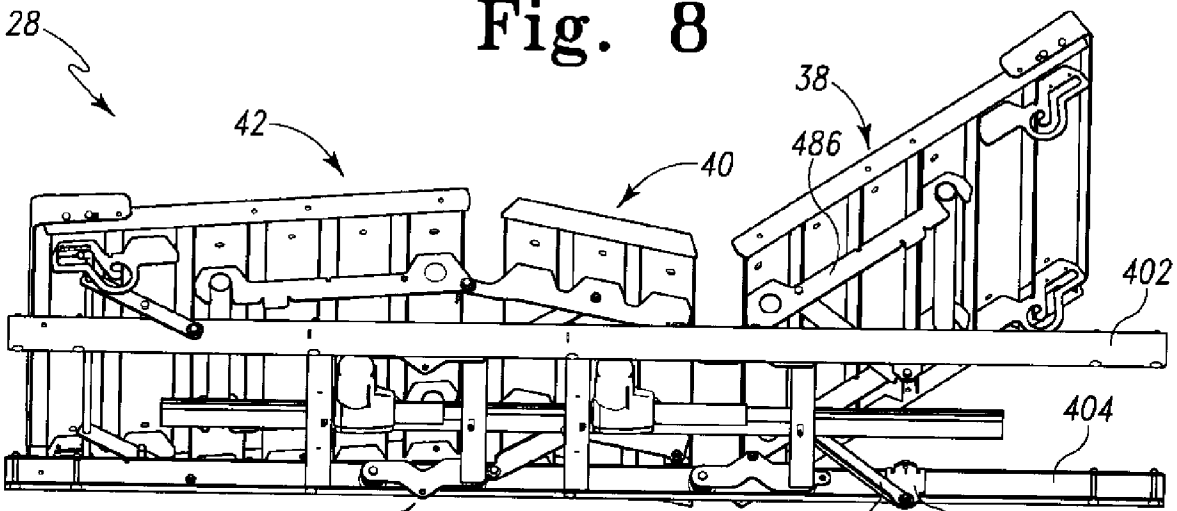
FIG. 9 is a perspective view of the patient-support platform of FIG. 8, the perspective taken from the below the platform on the patient left side of the platform.
Figure 10A:
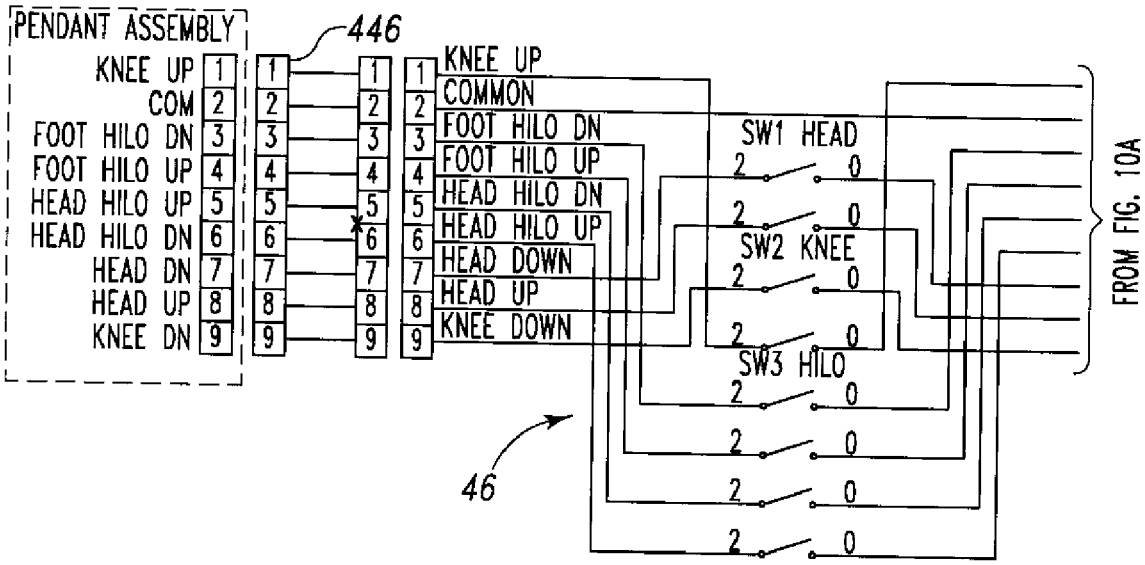
FIG. 10A is a portion of a schematic diagram of the electrical system of the embodiment of patient-support apparatus of FIG. 1.
Figure 10B:
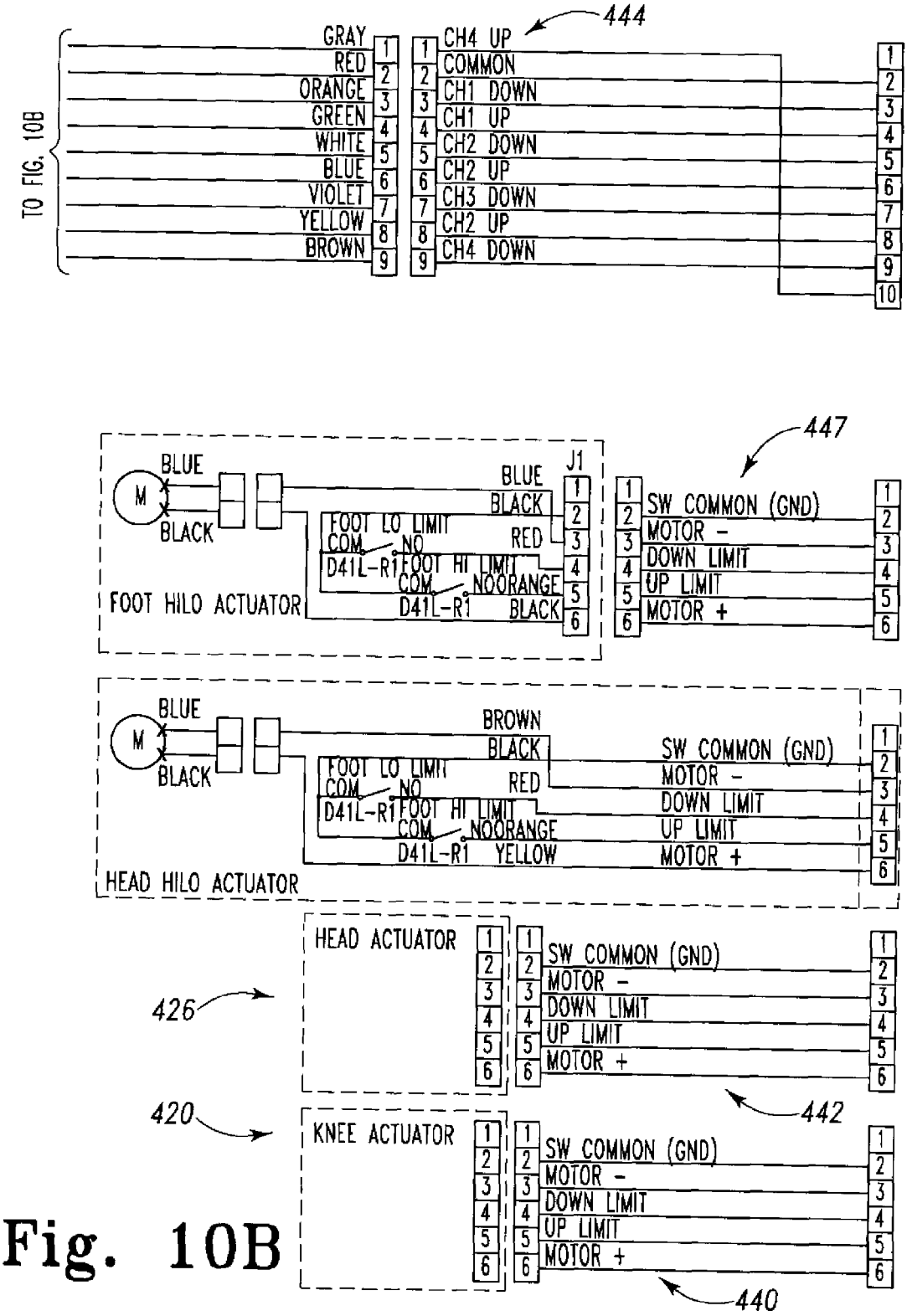
FIG. 10B is a portion of a schematic diagram of the electrical system of the embodiment of patient-support apparatus of FIG. 1.
Figure 10C:
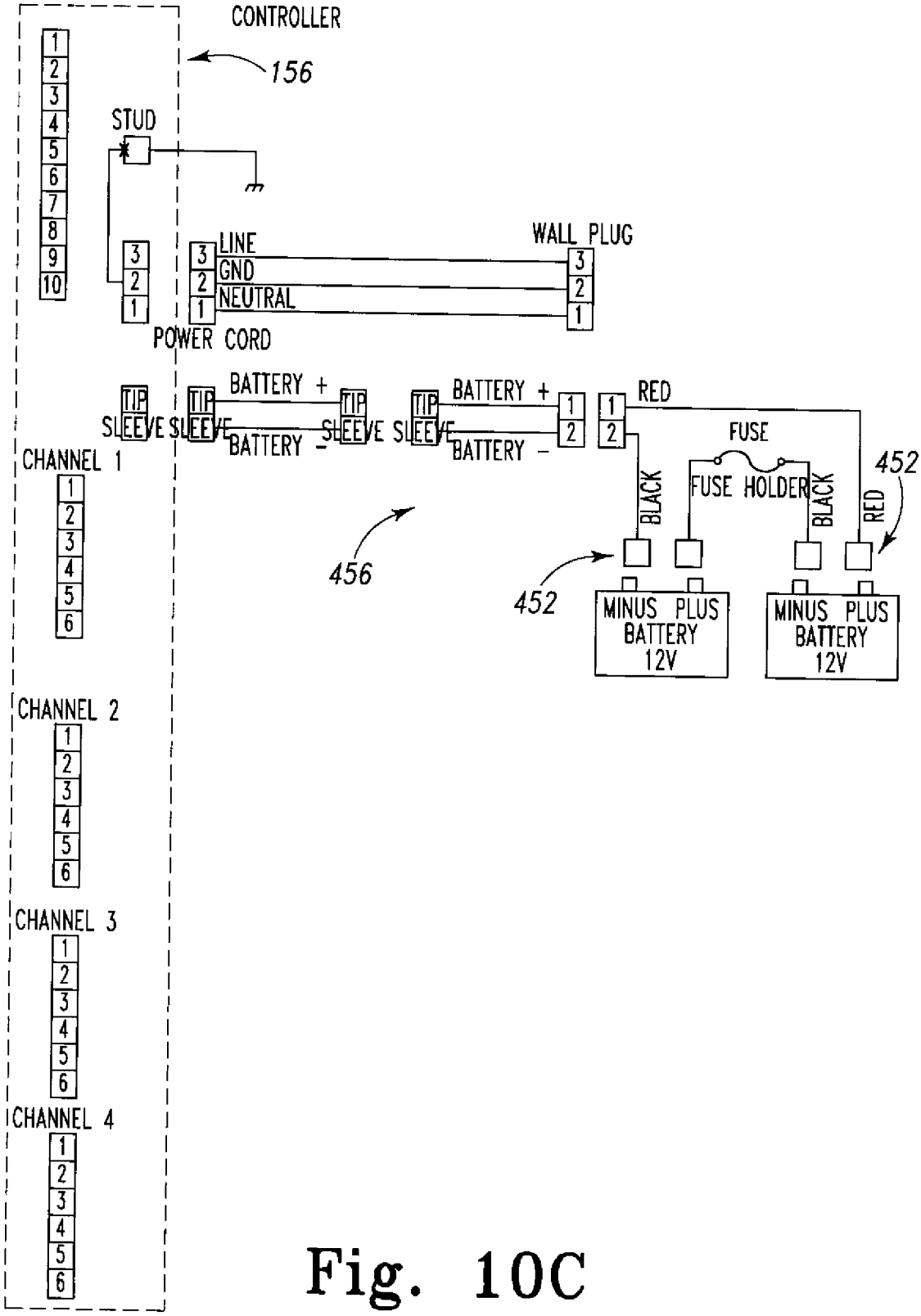
FIG. 10C is a portion of a schematic diagram of the electrical system of the embodiment of patient-support apparatus of FIG. 1.

Patient-support platform 28 includes a head deck section 38, a seat deck section 40, and a foot deck section 42 which are each supported on a frame 44 (seen best in FIG. 5). Deck sections 38, 40 and 42 are each pivotable relative to frame 44 to vary the position of a patient-supported thereon. In the illustrative embodiment, bed 10 further includes a mattress 30 which is supported on the deck sections 38, 40 and 42 and on which a patient is supported.

Foot end lift system 32 and head and lift system 34 each support frame 44 and are operable to raise and lower the respective ends of the patient-support platform 28. Foot end lift system 32 includes a user input panel 46 which may be used by a caregiver to deactivate the various drives of the bed 10 to lockout movement of the seat deck section 40, head deck section 38, and/or the lift systems 32, 34. Head end lift system 34 is substantially similar to the foot end the system 32, however it should be noted that head end lift system 34 has the user input panel 46 omitted. The following discussion will describe the structure of the foot end lift system 32 and it should be understood that head end lift system 34 is a similar structure. While in the illustrative embodiment only lift system 34 includes user input panel 46, it should be understood that the system 32 could also include a user input panel 46 in some embodiments. Similarly, it should be understood that user input panel 46 may be omitted from both of the lift systems 32 and 34 in some embodiments and the user input devices could be positioned elsewhere on patient-support apparatus 10.

Figure 2:
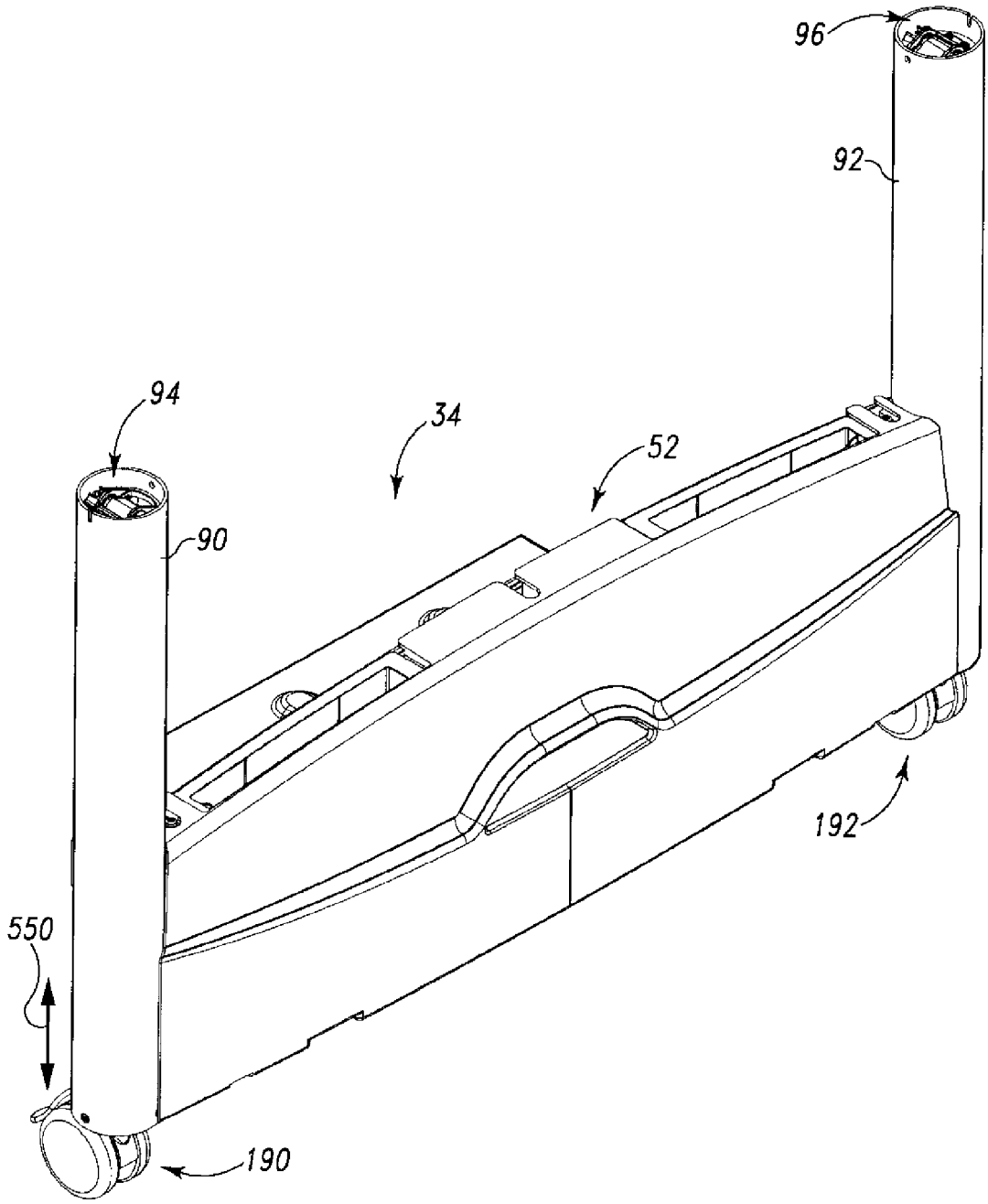
FIG. 2 is a perspective view of an embodiment of a lift system head end lift system of the patient-support apparatus of FIG. 1 with portions of the lift system omitted.

Referring to FIG. 2, the general operation of the lift system 34 involves the movement of supports 94 and 96 within tubes 90 and 92 respectively. The lift system 34 includes a pair of tethers coupled to supports 94 and 96 respectively. A winder supported on a carriage 52 of lift system 34 winds the tethers upon a spool which thereby shortens the length of the tethers. This causes the tubes 90 and 92 and carriage 52 to move vertically upwardly along the direction of arrow 550 and the supports 94 and 96 to extend from the tubes 90 and 92. The patient-support platform 28 is supported at each end by one of the lift systems 32 and 34. Movement of the patient-support platform 28 to change the elevation of the platform is effectuated by the two winders in the respective lift systems 32 and 34. The carriage 52 and platform 28 are vertically lowered along the direction of arrow 550 when the tether is unwound from the spool.

Further discussion of the operation of the lift systems is disclosed in a patent application titled LIFT SYSTEM FOR A PATIENT-SUPPORT APPARATUS filed Dec. 19, 2007, and an application Ser. No. 11/960,254, which is incorporated in its entirety by reference herein. In general, various configurations of a controller 156 are used to control the operation of the bed 10 based on the power available to the system. Various configurations of controller are available from Linak U.S., Inc. of Louisville, Ky. For example, a part number CB6036 controller from Linak is configured for mains power of 120VAC at 60 Hz. A part number CB6035 from Linak is configured for mains power of 230VAC at 50 Hz. A CB6037 from Linak is configured for 100VAC at 50 Hz. Each of these units converts power from mains to operate the DC drive system of the bed. In addition, each of the systems includes a battery charger to charge a standby battery which may be used when the bed 10 is disconnected from mains.

Frame 44 includes a left rail 402 and a right rail 404 and a pair of cross-members 406 and 408 which are coupled to the rails 402 and 404. In the illustrative embodiment, cross-members 406 and 408 are coupled to rails 402 and 404 by a plurality of bolts 410 which are secured with a plurality of nuts 412. Frame 44 further includes a pair of carriage assemblies 414 and 416 which are movable relative to the rails 402 and 404 along a direction perpendicular to the longitudinal axis 418 of frame 44. Carriage 414 is configured to cause pivoting of seat section 40 relative to frame 44. Similarly, carriage 416 is configured to cause pivoting of head section 38 relative to frame 44.

A first actuator 420 is coupled to cross-member 406 by a bolt 422 secured by a nut 424. A second actuator 426 is secured to cross-member 408 by another bolt 422 secured by a nut 424. Extension and retraction of actuator 420 causes carriage 414 to move relative to frame 44. Similarly, extension and retraction of actuator 426 causes carriage 416 to move relative to frame 44. In the illustrative embodiment, the actuator 426 is part number LA27-U038-00 and actuator 420 is part number LA27-U039-00 both of which are available from Linak U.S., Inc. of Louisville, Ky.

Each of the carriages 414 and 416 has a similar structure. The carriages include first and second roller brackets 428 and 430. A crossbar 432 spans the width of frame 44 and connects roller brackets 428 and 430. Each roller bracket 428 and 430 includes a plurality of roller bearings 434 onto which a roller 436 is positioned. In the illustrative embodiment each carriage includes two rollers 436 positioned on each side of the carriage 414, 416. Two of the rollers 436 are received in channel 402 and two of the rollers 436 are received in the channel 404 such that carriages 414 and 416 are supported on frame 44 through the interface of rollers 436 with channels 402 and 404. Actuators 420 and 426 are secured to crossbars 432 via a bolt 422 secured by a nut 424.

Figure 4:
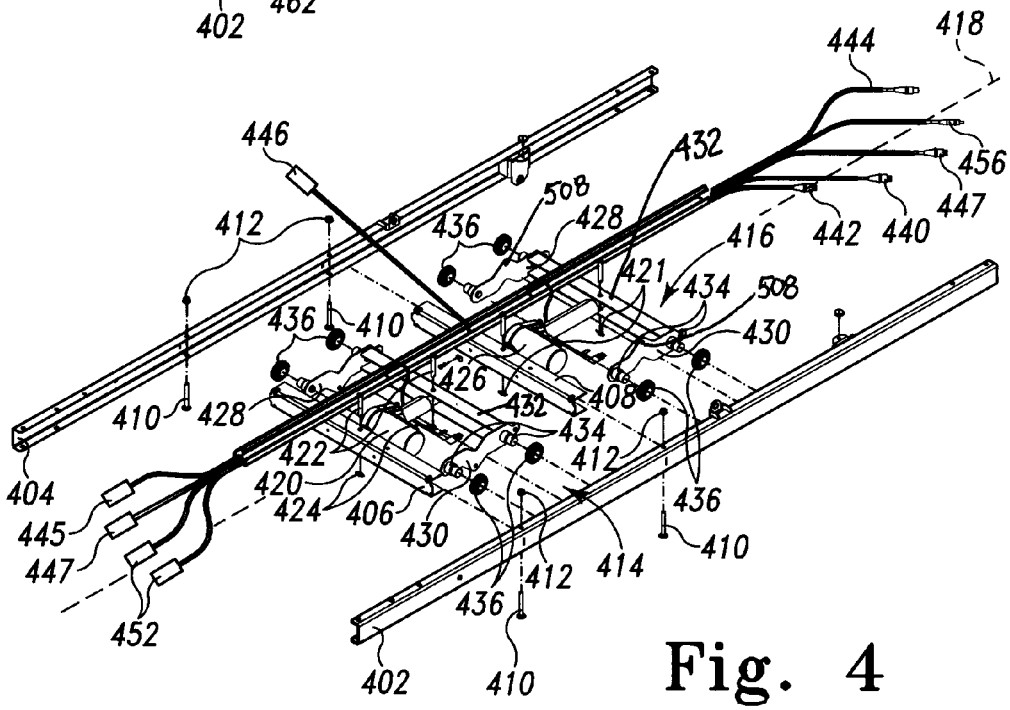
FIG. 4 is an exploded assembly view of a portion of the patient-support platform of FIG. 3.

Referring to FIG. 4, a conduit 438 is supported on frame 44 and supports various cables which extend between the foot end lift 32 and the head end lift 34. A cable 440 communicates between the controller 156 (shown diagrammatically in FIG. 11) and the actuator 420. Another cable 442 communicates between the controller and actuator 426. A cable 444 communicates between the user input panel 46 via a connector 445, a pendant connector 446 coupled to the pendant 448, and the controller 156. Yet another cable 450 communicates between a pair of battery connectors 452 and controller 156. Still another cable 447 communicates between controller 156 and foot end lift system 32. Each of these cables is positioned in conduit 438 to reduce the potential for entanglement with the moving portions of bed 10.

Figure 3:
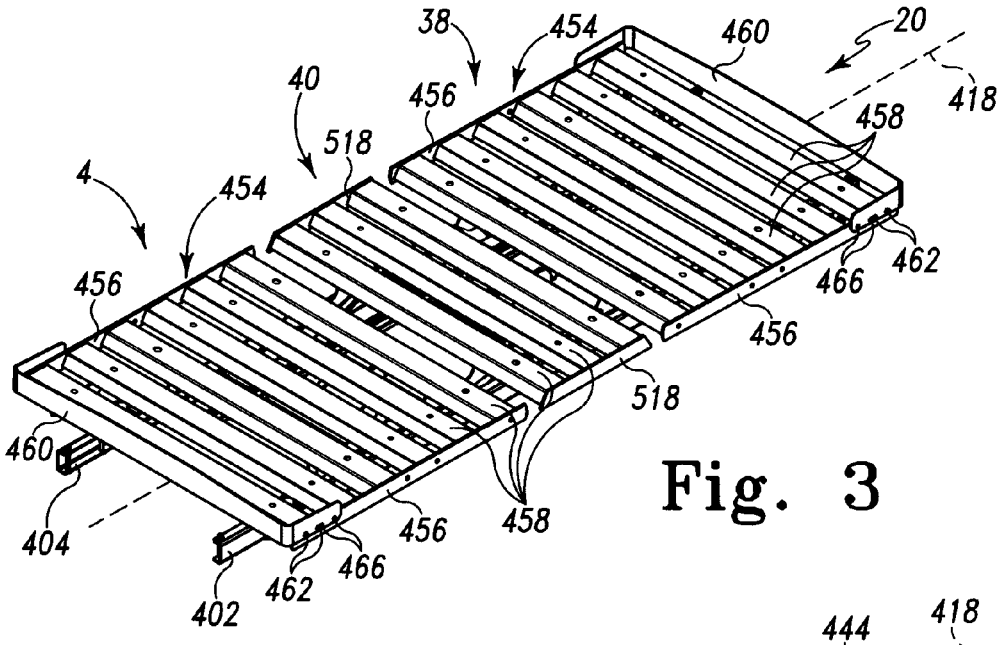
FIG. 3 is a perspective view of a patient-support platform of the embodiment of patient-support apparatus of FIG. 1.

Referring now to FIG. 3, deck sections 38, 40 and 42 are simple assemblies which provide support for mattress 30. Head deck section 38 and foot deck section 42 each have a common frame 454 which includes a pair of side members 456, 456 positioned on either side of the frame 454. A plurality of slats 458 span the width of frame 454 and are coupled to the side members 456, 456. In the illustrative embodiment, the slats 458 are welded to the side members 456. Each section 38 and 42 further includes a mattress retainer 460 secured to the sections 38 and 42 by a plurality of bolts 462 and nuts 464. Mattress retainer 460 is configured with multiple holes 466 such that mattress retainer 460 can be secured to sections 38 and 42 in a plurality of positions. As shown in FIGS. 3 and 5, mattress retainer 460 is secured in a first position which supports a first mattress length. The mattress retainer 460 can be secured using the alternative holes to support and retain a mattress having a length greater than the first length. The frame 44 may be coupled to lift systems 32 and 34 in multiple positions to accommodate the multiple lengths of mattress as well.

Deck sections 38 and 42 each further include a pair of brackets 466, 466. The brackets 466 are configured to engage a support structure 468 configured to support the deck 42. Brackets 466 are formed to include a channel 470 which in which a crossbar 472 of support structure 468 is received. When the crossbar 472 is positioned in the channel 470 at a first end 474 as shown in FIGS. 3 and 5, the foot end of foot deck section 42 is maintained in a lowered position relative to the frame 44. When the crossbar 472 is positioned in the end 476 of channel 470, the foot end of foot deck section 42 is raised relative to the seat section 40 as is known in the art. Thus, the seat deck section 40 and foot deck section 42 are positionable to elevate a patient's legs relative to the frame 44 to achieve a vascular position, for example. Support structure 468 includes a pair of arms 478, 478 coupled to crossbar 472 and pivotably coupled to the rails 402 and 404 of frame 44 by bolts 480, washers 482 and nuts 484.

Frames 454 further include a pair of brackets 486, 486 which facilitate pivotable coupling of sections 38 and 42 to other portions of the patient-support platform 28. Head deck section 38 is pivotably coupled to the carriage 416 by a plurality of bolts 488, washers 490, and bolts 492. A link 494 is pivotably coupled to each of the brackets 486 by a bolt 496 and a nut 498. Each link 494 is also coupled to a pivot support 512 coupled to a respective rail 402 or 404 of frame 44 by a bolt 500, washer 502, washer 504 and a nut 506. Pivot supports 512, 512 cooperate to define a pivot axis 514. Thus, head deck section 38 is pivotably coupled to the carriage 416 and coupled to the support frame 44 by the pivotable links 494, 494. Roller brackets 428, 428 of carriage 416 are formed to include pivot supports 508, 508 to which brackets 486, 486 are secured. The two pivot supports 508, 508 cooperate to define a pivot axis 510.

Seat deck section 40 includes a pair of side members 518, 518 with a plurality of slats 458 spanning the width of section 40. Slats 458 are welded to the side members 518. Seat deck section 40 further includes two brackets 520 and 522 coupled to the underside of the slats 458. Each of the brackets 520 and 522 are coupled to a respective pivot support 524, 526 of rails 402 and 404. Pivot supports 524 and 526 cooperate to define a pivot axis 528 about which seat deck section 40 pivots relative to frame 44. Brackets 520 and 522 are each secured to a pivot support 524 or 526 by a bolt 488, washers 490, and nut 492.

Brackets 486, 486 of foot deck section 42 are each coupled to a respective one of the brackets 520 or 522 of seat deck section 40 by a bolt 488, washers 490, and nut 492. Thus, foot deck section 42 is pivotable relative to seat deck section 40.

Seat deck section 38 is coupled to carriage 414 by a pair of links 530, 530 which are each coupled to one of the brackets 520, 522 respectively by a bolt 488, washers 490, and nut 492. Roller brackets 428, 428 of carriage 414 formed to include pivot supports 516, 516 which cooperate to define a pivot axis 518. Links 530, 530 are each pivotably coupled to one of the pivot supports 516, 516 by a bolt 488, washers 490, and nut 492. Links 530, 530 are therefore pivotable relative to both the seat deck section 40 and the carriage 414.

Actuators 420 and 426 each extend and retract along their axis, parallel to the longitudinal axis 418 of the frame 44. Referring to FIGS. 6-9, the movement of various portions of patient-support platform 28 is illustrated. As actuator 426 extends, carriage 416 moves along the rails 402 and 404. Thus, pivot axis 510 translates along frame 44. Links 494, 494 act on head deck section 38 causing head deck section 38 to pivot about axis 510 as actuator 426 extends from the position shown in FIGS. 6 and 7 to the position shown in FIGS. 8 and 9. Links 494, 494 also pivot about axis 514. Carriage 416 moves in a plane along the rails 402 and 404 in a direction parallel to the longitudinal axis 418. The plane in which the carriage moves is defined by the axes of rotation of each of the rollers 436 which cooperate to define the plane. By maintaining the movement of the carriage 416 in a plane, the actuator 426 is only loaded along the extension axis of the actuator.

This reduces the strength required necessary for the actuator to support a side load, thereby reducing the size and cost of the actuator.

Also, movement of carriage 416 results in movement of head deck section 38 away from seat deck section 40 as head deck section 38 moves because the pivot axis translates. This reduces the potential for abdominal discomfort for a patient supported on bed 10 when both the head deck section 38 and the seat deck section 40 are raised at the same time.

Articulation of the seat deck section 40 relative to the frame 44 also takes advantage of planar movement of carriage 414 similar to the planar movement of carriage 416 to reduce the size and cost of actuator 420. As carriage 414 moves along rails 402 and 404, links 530, 530 act on seat deck section 40 to cause section 40 to pivot about axis 528 between the position shown in FIGS. 6 and 7 and the position shown in FIGS. 8 and 9. Pivoting of the seat section 40 also causes foot deck section 42 to pivot relative to seat deck section 40 and on support structure 468 relative to frame 44.

Having a "knock-down" type construction, bed 10 is suitable for use in a home as the various portions of bed 10 can be disassembled and assembled with the use of standard tools. Thus, frame 33, lift systems 32 and 34 and deck sections 38, 40 and 42 can be shipped separately and assembled on site. In general, articulating beds employing compound movement of deck sections relative to a frame are bulky and difficult to use in a non-institutional environment. Also, bed 10 is configured with pivot points inboard from the edges of the various deck sections which reduces the potential for bunching of bed linens about the pivots when the bed linens are used for an extended period. Because the carriages 414 and 416 effectuate movement of deck sections 38, 40 and 42 above frame 44 with no swinging movement of linkages below the frame 44, platform 28 can be lowered very near to the floor such that the risk of falls for a person exiting bed 10 is reduced.

Although certain illustrative embodiments have been described in detail above, variations and modifications exist within the scope and spirit of this disclosure as described and as defined in the following claims.

The invention claimed is:

1. A patient-support apparatus comprising a support frame having a longitudinal axis, a first deck section coupled to the support frame, a first carriage movable along the longitudinal axis of the support frame, the first carriage including pivot supports defining a first pivot axis, a second deck section pivotable relative to the support frame about the first pivot axis, and an actuator having a longitudinal axis generally parallel to the longitudinal axis of the support frame, the actuator coupled to the first carriage and the support frame, wherein the actuator is operable to move the first carriage along the longitudinal axis of the support frame such that the first pivot axis moves away from the first deck section in a plane that is generally parallel to both the longitudinal axis of the support frame and the longitudinal axis of the actuator throughout the travel of the first pivot axis.

2. The patient-support apparatus of claim 1, wherein the second deck section is pivotably coupled to the first carriage and is coupled to the support frame by a link that is pivotably coupled to the second deck section and pivotably coupled to the support frame, and wherein the link urges the second deck section to pivot as the carriage moves.

3. The patient-support apparatus of claim 2, wherein the first carriage includes a first pivot support which defines the first pivot axis.

4. The patient-support apparatus of claim 3, wherein the first deck section is coupled to a second carriage and the first deck section is pivotable relative to the support frame.

5. The patient-support apparatus of claim 1, further comprising a third deck section pivotable relative to the support frame and a second carriage, wherein movement of the second carriage causes the third deck section to pivot relative to the support frame.

6. The patient-support apparatus of claim 5, wherein the first carriage and second carriage move in a common plane.

7. The patient-support apparatus of claim 6, wherein the common plane is generally parallel to the longitudinal axis of the support frame.

8. The patient-support apparatus of claim 7, wherein the third deck section is pivotably coupled to the first frame.

9. The patient-support apparatus of claim 5, wherein the third deck section is pivotably coupled to the first frame.

10. The patient-support apparatus of claim 9, wherein the patient-support further comprises a link pivotably coupled to the second carriage and the first deck section such that as the second carriage moves, the link urges the first deck section to pivot relative to the support frame.

11. A patient-support apparatus comprising a support frame, a first carriage movable along a longitudinal axis of the support frame, a first actuator coupled to the support frame and the first carriage, the first actuator having a longitudinal axis that is generally parallel to the longitudinal axis of the support frame and the first actuator is operable to move the carriage along the longitudinal axis of the support frame, and a first deck section pivotably coupled to the carriage at a first pivot support and coupled to the support frame such that movement of the carriage along the longitudinal axis of the support frame translates the first pivot support along the support frame in a plane that is generally parallel to the longitudinal axis of the actuator and the longitudinal axis of the support frame and the first deck section is urged to pivot about the translating first pivot support.

12. The patient-support apparatus of claim 11, wherein the first actuator does not pivot relative to the support frame.

13. The patient-support apparatus of claim 11, wherein the support frame comprises two generally parallel longitudinal channels and a plurality of cross-members coupled to each of the longitudinal channels.

14. The patient-support apparatus of claim 13, wherein the first carriage moves along the longitudinal channels.

15. The patient-support apparatus of claim 14, wherein the first actuator is coupled to a first one of the cross-members.

16. The patient-support apparatus of claim 15, wherein the first carriage comprises a pair of roller brackets, a crossbar coupled to the roller brackets, and a plurality of rollers rotatably coupled to each of the roller brackets, the rollers configured to be received in the longitudinal channels.

17. The patient-support apparatus of claim 16, wherein the first actuator is coupled to the crossbar such that extension of the first actuator moves the first carriage away from the first cross-member.

18. The patient-support apparatus of claim 16, wherein the rollers each rotate about a respective rotation axis and wherein the rotation axes cooperate to define a plane and the carriage moves in the plane along a direction generally parallel to the longitudinal axis of the support frame.

19. The patient-support apparatus of claim 18, wherein the first deck section is coupled to the support frame by a link pivotably coupled to the first deck section and pivotably coupled to the support frame.

20. The patient-support apparatus of claim 13, wherein the first carriage comprises a pair of roller brackets, a crossbar coupled to the roller brackets, and a plurality of rollers rotatably coupled to each of the roller brackets.

21. The patient-support apparatus of claim 20, wherein the first actuator is coupled to the crossbar such that extension of the first actuator moves the first carriage away from a first cross-member.

22. The patient-support apparatus of claim 21, wherein the rollers each rotate about a respective rotation axis and wherein the rotation axes cooperate to define a plane and the carriage moves in the plane along a direction generally parallel to the longitudinal axis of the support frame.

23. The patient-support apparatus of claim 22, wherein the patient-support apparatus comprises a second carriage movable along the longitudinal axis of the support frame, a second actuator coupled to the support frame and the second carriage, the second actuator operable to move the second carriage along the longitudinal axis of the support frame, and a second deck section pivotably coupled to the support frame and coupled to the second carriage such that movement of the second carriage along the longitudinal axis urges the second deck section to pivot relative to the support frame.

24. A patient-support apparatus comprising a support frame, a first carriage movable along a longitudinal axis of the support frame, a first actuator coupled to the support frame and the first carriage, the first actuator having a longitudinal axis that is generally parallel to the longitudinal axis of the support frame and the first actuator is operable to move the carriage along the longitudinal axis of the support frame, and a first deck section pivotably coupled to the carriage at a first pivot support and coupled to the support frame such that movement of the carriage along the longitudinal axis of the support frame translates the first pivot support along the support frame in a plane that is generally parallel to the longitudinal axis of the actuator and the longitudinal axis of the support frame and the first deck section is urged to pivot about the translating first pivot support, wherein the support frame comprises two generally parallel longitudinal channels and a plurality of cross-members coupled to each of the longitudinal channels, wherein the first carriage moves along the longitudinal channels, wherein the first actuator is coupled to a first one of the cross-members, wherein the first carriage comprises a pair of roller brackets, a crossbar coupled to the roller brackets, and a plurality of rollers rotatably coupled to each of the roller brackets, the rollers configured to be received in the longitudinal channels wherein the first actuator is coupled to the crossbar such that extension of the first actuator moves the first carriage away from the first cross-member, wherein the rollers each rotate about a respective rotation axis and wherein the rotation axes cooperate to define a plane and the carriage moves in the plane along a direction generally parallel to the longitudinal axis of the support frame, wherein the patient-support apparatus comprises a second carriage movable along the longitudinal axis of the support frame, a second actuator coupled to the support frame and the second carriage, the second actuator operable to move the second carriage along the longitudinal axis of the support frame, and a second deck section pivotably coupled to the support frame and coupled to the second carriage such that movement of the second carriage along the longitudinal axis urges the second deck section to pivot relative to the support frame, and wherein each of the carriages comprise a pair of roller brackets, a cross-section bar coupled to the roller brackets, and a plurality of rollers rotatably coupled to the each of the roller brackets, the rollers configured to be received in the longitudinal channels such that the carriage moves along the longitudinal channels, and wherein the first and second actuators are each coupled to one of the cross-members such that the first and second actuators do not pivot relative to the support frame as the carriage moves along the longitudinal channels.

* * * * *